United States Patent [19]

Rentmeester

[11] 4,033,474

[45] July 5, 1977

[54] TUBULAR BODY WITH A LAP SIDE SEAM

[75] Inventor: Kenneth Richard Rentmeester, Barrington, Ill.

[73] Assignee: American Can Company, Greenwich, Conn.

[22] Filed: Mar. 28, 1973

[21] Appl. No.: 345,548

Related U.S. Application Data

[62] Division of Ser. No. 75,530, Sept. 25, 1970, Pat. No. 3,760,750.

[52] U.S. Cl. ..... 220/75; 138/156; 138/170; 220/81 R; 156/218

[51] Int. Cl.[2] ..... B65D 1/16

[58] Field of Search ..... 156/203, 218, 298; 113/12, 120 R, 120 F, 120 K, 120 V, 120 Y; 220/75, 81 R; 138/163, 167, 170, 156; 161/99, 100, 103, 107, 139

[56] References Cited

UNITED STATES PATENTS

| | | | |
|---|---|---|---|
| 1,332,932 | 3/1920 | Sussman | 113/120 F |
| 2,120,007 | 6/1938 | Tear | 113/120 F |
| 3,066,063 | 11/1962 | Ecklund et al. | 156/203 |
| 3,411,542 | 11/1968 | Walsh et al. | 156/218 |
| 3,411,690 | 11/1968 | Walsh et al. | 220/75 |
| 3,419,183 | 12/1968 | Khoury | 113/120 K |
| 3,437,063 | 4/1969 | Battersby | 220/75 |
| 3,452,694 | 7/1969 | Ratzer | 113/120 R |
| 3,700,513 | 10/1972 | Haberhauer et al. | 156/203 |

*Primary Examiner*—Charles E. Van Horn
*Assistant Examiner*—Basil J. Lewris
*Attorney, Agent, or Firm*—Robert P. Auber; George P. Ziehmer

[57] ABSTRACT

The raw metal edge on the inside lap in an adhesively-bonded lap side seam of a tubular body is protected from chemical attack by a corrosive substance from within the tubular body by applying a side seam adhesive along one marginal edge portion of the body blank, bending the other parallel marginal edge portion of the blank to form a crease thereon, rolling the blank into tubular form to place the adhesively-coated marginal edge portion and the creased marginal edge portion in an overlapping, facing position, and imbedding the creased marginal edge portion into a portion of the adhesive on the one marginal edge portion to bury the raw metal edge, the imbedding being achieved by compressing the overlapped marginal edge portions together to assemble the lap side seam of the tubular body.

1 Claim, 6 Drawing Figures

TUBULAR BODY WITH A LAP SIDE SEAM

This is a division, of application Ser. No. 75,530 filed Sept. 25, 1970 now U.S. Pat. No. 3,760,750.

BACKGROUND OF THE INVENTION

The present invention relates to tubular bodies formed with a longitudinally extending adhesively-bonded lap side seam and more particularly is concerned with the construction of the adhesively-bonded lap side seam.

In the formation of a lap side seam, the overlapped marginal edges usually terminate in a raw metal edge. The outer surface of the tubular body may be readily protected against various forms of chemical attack by the application over this surface, including the raw metal edge on the outside lap, of some sort of protective coatings.

However, it has been found to be exceedingly difficult to adequately protect and cover the raw metal edge on the inside lap by means heretofore known to the prior art. This is the case, for example, where the tubular body is a container in which it is desired to package a particularly corrosive substance, such as a carbonated beverage.

Accordingly, the present invention is concerned with a novel construction of the adhesively-bonded lap side seam wherein the inside lap has a crease running the entire length of the body blank, which crease is imbedded into the side seam adhesive on the opposite surface of the outside lap.

The purpose, therefore, for creasing or bending the inside lap edge portion of the body blank is so that during the subsequent tubular body forming operations the raw metal edge on the inside lap will be more easily and effectively buried and covered with the side seam adhesive and, further, the side seam stripe and topcoat.

The advantage or benefit to be gained by covering the raw metal edge on the inside lap is the protection of the raw metal edge from chemical attack by a corrosive substance within the tubular body. Particularly, with regard to containers for packaging carbonated beverages, the advantage in burying the raw metal edge on the inside lap into the side seam adhesive is in the substantial reduction of iron pickup by a corrosive carbonated beverage which will ultimately be packaged within the container.

Even though the present invention has particular importance with regard to tubular bodies used as containers for carbonated beverages, the invention also has been found useful in connection with other uses for lap side seam tubular bodies, such as telephone cables, where certain materials within the cable may chemically attack any exposed raw metal surfaces inside the cable.

SUMMARY OF THE PRESENT INVENTION

The present invention relates to a method and apparatus for providing a crease on the inside lap in an adhesively-bonded lap side seam of a tubular body and the particular construction of the lap side seam which includes the crease on the inside lap as a part thereof. As a novel way of protecting the raw metal edge on the inside lap from chemical attack by corrosive materials within the tubular body, the marginal edge portion of the inside lap is creased when the tubular body is in blank form, then the creased marginal edge portion is overlapped by an adhesively-coated opposite marginal edge portion and buried into the adhesive when the lap side seam of the tubular body is assembled, assembly of the lap side seam being effected by compressing the overlapped marginal edge portions together. Also, provision of the buried creased marginal edge portion allows for more effective coverage of the inside lap side seam area by a side seam stripe.

DESCRIPTION OF THE PREFERRED EMBODIMENT

Figures 1, 2, 3, 4, 5, 6:
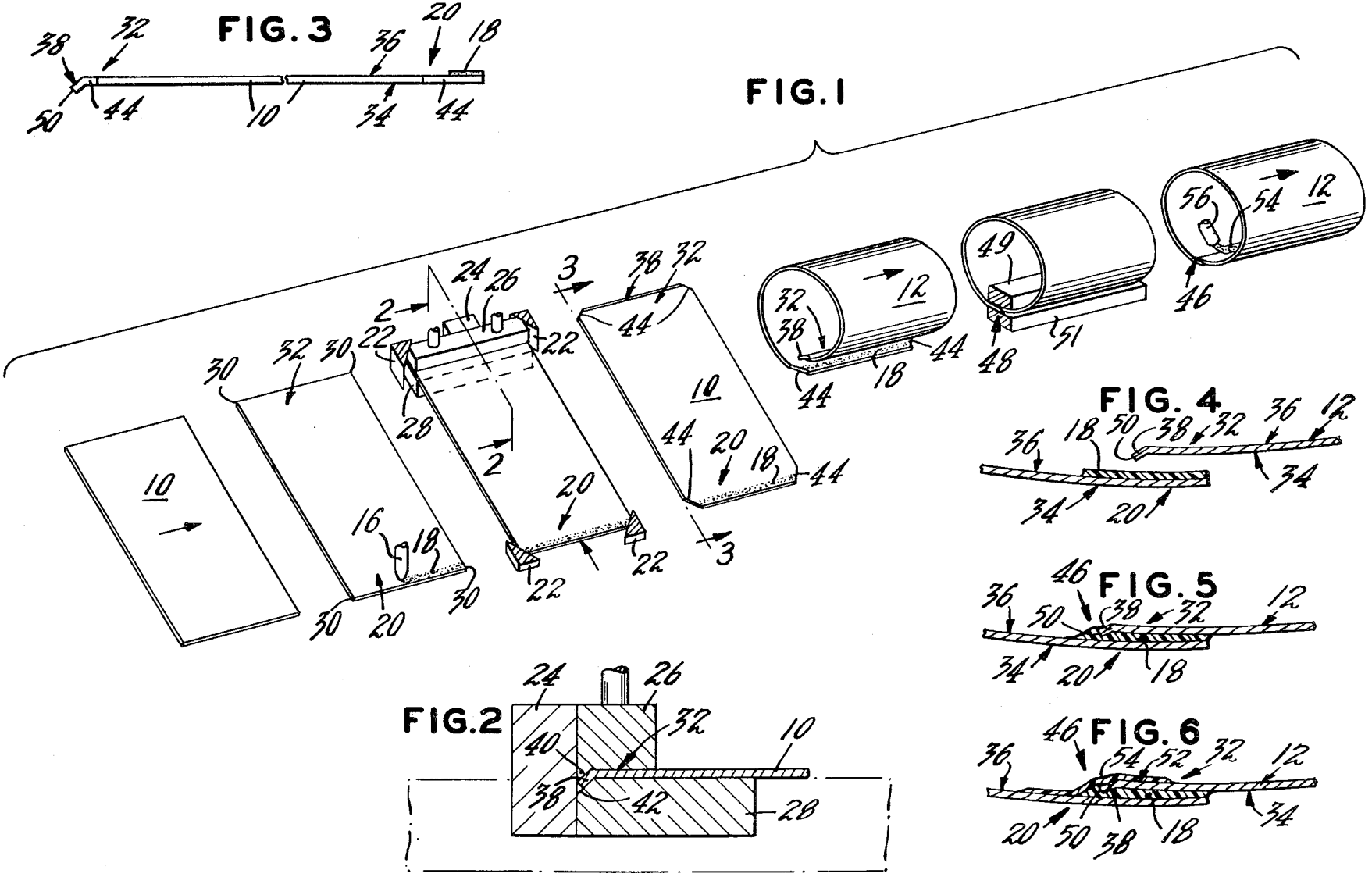
FIG. 1 is a schematic view in perspective illustrating the method and apparatus of the present invention.
FIG. 2 is an enlarged fragmentary sectional view taken substantially along lines 2—2 of FIG. 1.
FIG. 3 is an enlarged fragmentary side elevational view taken substantially along line 3—3 of FIG. 1.
FIG. 4 is an enlarged fragmentary sectional view of the overlapped marginal edge portions before the adhesively-bonded lap side seam is formed.
FIG. 5 is an enlarged fragmentary sectional view of the adhesively-bonded lap side seam having the crease on the inside lap.
FIG. 6 is an enlarged fragmentary sectional view of the adhesively-bonded lap side seam having the crease on the inside lap and a side seam stripe on the inside lap side seam surface area.

As a preferred or exemplary embodiment of the instant invention, FIG. 1 shows a sequence of operations for forming a substantially rectangular body blank, generally designated 10, into an open ended tubular body, generally designated 12, wherein such sequence of operations, novel steps provide a new lap side seam construction for the tubular body 12. The term tubular as used herein is meant to denote an elliptical, rectangular or polygonal cross sectional shape as well as circular.

In the usual manner of fabricating tubular bodies having adhesively-bonded lap side seams, an organic cement or adhesive is extruded or otherwise, in a suitable manner, deposited on one marginal edge portion of a body blank. A detailed disclosure of one such suitable process for preparing body blanks with an adhesive on one marginal edge portion thereof is more particularly set forth in U.S. Pat. No. 3,481,809 which issued Dec. 2, 1969, which process may be used in conjunction with the present invention. As shown in FIG. 1, an applicator nozzle 16 deposits a suitable organic cement or adhesive 18 along the full length of one marginal edge portion 20 of the body blank 10. The side seam adhesive 18, as applied to blank 10, extends inwardly from the edge of the marginal portion 10, i.e. has a width of from 7/32 to 9/32 and preferably ¼, and upwardly from the marginal portion 20, i.e. has a thickness of from 0.003 to 0.006 and preferably from 0.004 to 0.005.

The body blank 10 with the side seam adhesive 18 on one marginal edge portion 20 thereof is then positioned by any suitable means, such as a conveyor as shown in the aforementioned U.S. Pat. No. 3,481,809, within a set of notching dies, generally designated 22. Between the notching dies 22 on the left hand side of the blank 10, as shown in FIG. 1, provision is made for the incorporation of a novel creasing operation. As further shown in FIG. 2, a gage plate 24 is adjustably positioned adjacent a creasing member 26, which member 26 is movably positioned above a notch cut edge member 28. The blank 10 is moved, in the direction of the arrow on the right hand side of the blank 10 in FIG. 1, against gage plate 24 in order to properly align the blank 10 for the subsequent notching and creasing operations. The notching operation per se forms no part of the present invention and may be omitted where the concept of the present invention is used in the construction of lap side seam tubular bodies for applications other than for beverage containers, for instance, for telephone cables.

Concurrently with the operation of notching dies 22 which cut off the corner edge portions 30 of the blank 10, the other marginal edge portion 32 of the blank 10 is bent down by the creasing member 26. The creasing member 26 bends the marginal edge portion 32 down through an angle within the range of approximately 20° to 45° toward the surface 34 of the blank 10 which is opposite the surface 36 on which the side seam adhesive 18 is applied, to form a crease 38 thereon having a width within the range of approximately 0.015 to 0.060.

The creasing member 26, as shown in FIG. 2, which may be actuated with, or independently of, the notching dies 22 by any suitable driving means (not shown), has an angular projection 40 on one edge thereof which contacts the marginal edge portion 32 and bends it down into contact with a groove surface 42 on one edge of the notch cut edge member 28. The angular profile of projection 40 and groove 42 are selected to give the desired singular bend angle of the crease 38.

The blank 10 emerges from the notching and creasing operations, as shown in FIGS. 1 and 3, having notched corners 44 and the crease 38 formed on the left hand side of the blank 10.

The blank 10 is then formed into an open ended tubular body 12 by any suitable means, for example, on a high speed, automatic, can bodymaker by wrapping the blank around a mandrel, heating the side seam adhesive to a semi-fluid, tacky condition and compressing the overlapped marginal edge portions into intimate contact with the tacky side seam adhesive. Immediately thereafter the adhesively - bonded lap side seam is chilled to set the adhesive and to secure the lapped marginal edge portions together. Details of a particular bodymaker and other means which may be used for carrying out the above described operations are shown in U.S. Pat. Nos. 1,625,091 which issued Apr. 17, 1927 and 3,508,507 which issued on Apr. 28, 1970.

As schematically shown in FIG. 1, the blank 10 is rolled clockwise through a 180° path into the tubular body 12 in order to place the marginal edge portion 32 having the crease 38 thereon and the uncreased marginal edge portion 20 having the side seam adhesive 18 thereon in an overlapping, facing position, as shown in greater detail in FIG. 4. The marginal edge portion 20 now becomes the outside lap 20 and the marginal edge portion 32 now becomes the inside lap 32 of an adhesively - bonded lap side seam, generally designated 46, which is subsequently formed, as shown in FIGS. 5 and 6.

Next, compressing means, generally designated 48, comprised by an upper spline means 49 and a lower hammer means 51, bring the inside lap 32 having the crease 38 thereon into contact with the side seam adhesive 18 on the surface 36 of the outside lap 20 in order to assemble the lap side seam 46 of the tubular body 12. Thus, by the operation of the compressing means 48, the crease 38 on the inside lap 32 which points angularly in a single direction toward outside lap 20, becomes imbedded into a portion of the side seam adhesive 18 on the outside lap 20 so as to bury the raw metal edge 50 on the inside lap in the side seam adhesive 18 in a manner that raw metal edge 50 contacts only adhesive 18, as shown in FIG. 5. The side seam adhesive 18, after being chilled, has a thickness between the inside and outside laps 32, 20 of approximately 0.003 and 0.004. The thickness of the side seam adhesive 18 between the raw metal edge 50 and the surface 36 of the outside lap 20 is preferably from approximately 0.005 to 0.001. The thickness of the tubular body wall is approximately 0.006.

The provision of the buried crease 38 on the inside lap 32 in the adhesively-bonded lap side seam 46 further allows for more effected coverage of the inside lap side seam surface, generally designated 52 as shown in FIG. 6, by a side seam stripe 54 which is applied from an applicator means 56. The applicator means 56 is aligned with the buried raw metal edge 50 on the inside lap 32 so that the applied side seam stripe 54 is centered on the buried raw metal edge 50 and extends approximately ¼ on either side of the raw metal edge 50 along the inside lap side seam surface 52.

It is thought that the invention and many of its attendant advantages will be understood from the foregoing description and it will be apparent that various changes may be made in the form, construction and arrangement of the parts and that changes may be made in the steps of the method described and their order of accomplishment without departing from the spirit and scope of the invention or sacrificing all of its material advantages, the form hereinbefore described being merely a preferred or exemplary embodiment thereof.

I claim:

1. A tubular body, comprising:

a body blank with opposed longitudinal marginal edge portions forming an adhesively-bonded lap side seam wherein one longitudinal edge portion is uncreased and the other is creased;

a side seam adhesive on the inside surface of said marginal edge portion which is uncreased and forms the outer lap; and an outwardly extending crease on the other of said marginal edge portions which forms the inner lap and which points angularly in a single direction toward the outer lap, said crease being imbedded in the side seam adhesive on the outer lap such that a raw metal edge on the creased inner lap is buried in and contacts only the side seam adhesive.

* * * * *